US009532148B2

(12) United States Patent
Hau et al.

(10) Patent No.: US 9,532,148 B2
(45) Date of Patent: Dec. 27, 2016

(54) METHOD OF OPERATING A HEARING AID AND A HEARING AID

(71) Applicant: Widex A/S, Lynge (DK)

(72) Inventors: Ole Hau, Stenlose (DK); Morten Love Jepsen, Frederiksberg (DK)

(73) Assignee: Widex A/S, Lynge (DK)

( * ) Notice: Subject to any disclaimer, the term of this patent is extended or adjusted under 35 U.S.C. 154(b) by 0 days.

(21) Appl. No.: 14/739,372

(22) Filed: Jun. 15, 2015

(65) Prior Publication Data

US 2015/0281857 A1 Oct. 1, 2015

Related U.S. Application Data

(63) Continuation-in-part of application No. PCT/EP2012/076565, filed on Dec. 21, 2012.

(51) Int. Cl.
*H04R 25/00* (2006.01)
*G10L 21/0232* (2013.01)

(52) U.S. Cl.
CPC ..... *H04R 25/50* (2013.01); *H04R 25/353* (2013.01); *H04R 25/70* (2013.01); *G10L 21/0232* (2013.01); *H04R 2225/43* (2013.01)

(58) Field of Classification Search
CPC ..... H04R 25/35–25/356; H04R 25/50; H04R 25/505; H04R 25/70; H04R 2225/43; G10L 21/00; G10L 21/02; G10L 21/0208; G10L 21/0216; G10L 21/0232; G10L 21/0364
See application file for complete search history.

(56) References Cited

U.S. PATENT DOCUMENTS 5,687,241 A 11/1997 Ludvigsen
7,328,151 B2 * 2/2008 Muesch ..... G10L 21/0364 381/312
2002/0057808 A1 5/2002 Goldstein
(Continued)

FOREIGN PATENT DOCUMENTS

EP 1522206 B1 10/2007
WO 99/34642 A1 7/1999
(Continued)

OTHER PUBLICATIONS

International Search Report for PCT/EP2012/076565 dated Apr. 24, 2013.
(Continued)

*Primary Examiner* — Curtis Kuntz
*Assistant Examiner* — Joshua Kaufman
(74) *Attorney, Agent, or Firm* — Sughrue Mion, PLLC

(57) ABSTRACT

A method of processing a signal in a hearing aid (50) comprises splitting an input signal into a multitude N of hearing aid frequency bands, receiving an input signal from an acoustical-electrical transducer, splitting the input signal into a multitude N of hearing aid frequency bands using a first filterbank, estimating speech, noise and hearing loss levels in said frequency bands, using an auditory model of the cochlea for a hearing impaired person to provide excitation values for speech and noise in said frequency bands, using said excitation values to calculated a speech intelligibility measure and optimizing said speech intelligibility measure by iteratively varying the applied gain in the hearing aid frequency bands. The invention also provides a hearing aid (50).

7 Claims, 4 Drawing Sheets

(56) References Cited

U.S. PATENT DOCUMENTS

2009/0304215 A1* 12/2009 Hansen ..... G10L 21/0208
381/317
2010/0250242 A1 9/2010 Li

FOREIGN PATENT DOCUMENTS

| | | | |
|---|---|---|---|
| WO | 2004/008801 | A1 | 1/2004 |
| WO | 2007/025569 | A1 | 3/2007 |
| WO | 2012/076045 | A1 | 6/2012 |
| WO | 2013/091702 | A1 | 6/2013 |

OTHER PUBLICATIONS

H. Fletcher and R.H. Galt, "The perception of speech and its relation to telephony", J. Acoust. Soc. Am. 22, pp. 89-151 (1950).
ANSI S3.5-1997 Standard—American National Standard—Methods for Calculation of the Speech Intelligibility Index—May 18, 2007.

* cited by examiner

METHOD OF OPERATING A HEARING AID AND A HEARING AID

RELATED APPLICATIONS

The present application is a continuation-in-part of application PCT/EP2012076565, filed on Dec. 21, 2012, in Europe, and published as WO 2014094865 A1.

BACKGROUND OF THE INVENTION

1. Field of the Invention

The present invention relates to a method of operating a hearing aid. More specifically the invention relates to a method of operating a hearing aid wherein speech intelligibility for the user is optimized. Further the present invention relates to a hearing aid adapted to provide improved speech intelligibility.

In the context of the present disclosure, a hearing aid should be understood as a small, microelectronic device designed to be worn behind or in a human ear of a hearing-impaired user. A hearing aid system may be monaural and comprise only one hearing aid or be binaural and comprise two hearing aids. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a microelectronic circuit comprising a signal processor, and an acoustic output transducer (which may also be denoted a hearing aid receiver). The signal processor is preferably a digital signal processor. The hearing aid is enclosed in a casing suitable for fitting behind or in a human ear.

The mechanical design has developed into a number of general categories. As the name suggests, Behind-The-Ear (BTE) hearing aids are worn behind the ear. To be more precise, an electronics unit comprising a housing containing the major electronics parts thereof is worn behind the ear. An earpiece for emitting sound to the hearing aid user is worn in the ear, e.g. in the concha or the ear canal. In a traditional BTE hearing aid, a sound tube is used to convey sound from the output transducer, which in hearing aid terminology is normally referred to as the receiver, located in the housing of the electronics unit and to the ear canal. In some modern types of hearing aids a conducting member comprising electrical conductors conveys an electric signal from the housing and to a receiver placed in the earpiece in the ear. Such hearing aids are commonly referred to as Receiver-In-The-Ear (RITE) hearing aids. In a specific type of RITE hearing aids the receiver is placed inside the ear canal. This category is sometimes referred to as Receiver-In-Canal (RIC) hearing aids.

In-The-Ear (ITE) hearing aids are designed for arrangement in the ear, normally in the funnel-shaped outer part of the ear canal. In a specific type of ITE hearing aids the hearing aid is placed substantially inside the ear canal. This category is sometimes referred to as Completely-In-Canal (CIC) hearing aids. This type of hearing aid requires an especially compact design in order to allow it to be arranged in the ear canal, while accommodating the components necessary for operation of the hearing aid.

Prior to use, the hearing aid must be fitted to the individual user. The fitting procedure basically comprises adapting a transfer function dependent on level and frequency to best compensate the user's hearing loss according to the particular circumstances such as the user's hearing impairment and the specific hearing aid selected. The selected settings of the parameters governing the transfer function are stored in the hearing aid. The settings can later be changed through a repetition of the fitting procedure, e.g. to account for a change in impairment. In case of multi-program hearing aids, the adaptation procedure may be carried out once for each program, selecting settings dedicated to take specific sound environments into account.

According to the state of the art, hearing aids process sound in a number of frequency bands with facilities for specifying gain levels according to some predefined input/gain-curves in the respective bands.

The level-dependent transfer function is adapted for compressing the signal in order to control the dynamic range of the output of the hearing aid. The compression can be regarded as an automatic adjustment of the gain levels for the purpose of improving the listening comfort of the user of the hearing aid, and the compression may therefore be denoted Automatic Gain Control (AGC). The AGC also provides the gain values required for alleviating the hearing loss of the person using the hearing aid.

2. The Prior Art

Compression may be implemented in the way described in the international application WO-A1-9934642.

Advanced hearing aids may further comprise anti-feedback routines for continuously monitoring input signals and output signals in respective frequency bands for the purpose of continuously controlling acoustic feedback instability through providing cancellation signals and through lowering of the gain settings in the respective bands when necessary.

However, in all these "predefined" gain adjustment methods, the gain levels are modified according to functions that have been predefined during the programming/fitting of the hearing aid to reflect requirements for generalized situations.

Recently it has been suggested to use models for the prediction of the intelligibility of speech after a transmission though a linear system. The most well-known of these models is the "articulation index", AI, the speech intelligibility index, SII, and the "speech transmission index", STI, but other indices exist.

Determinations of speech intelligibility have been used to assess the quality of speech signals in telephone lines, see e.g. H. Fletcher and R. H. Galt "The perception of speech and its relation to telephony," J. Acoust. Soc. Am. 22, 89-151 (1950).

The SII is always a number between 0 (speech is not intelligible at all) and 1 (speech is fully intelligible). The SII is, in fact, an objective measure of the system's ability to convey speech intelligibility and hereby hopefully making it possible for the listener to understand what is being said.

The ANSI S3.5-1997 standard provides methods for the calculation of the speech intelligibility index, SII. The SII makes it possible to predict the intelligible amount of the transmitted speech information, and thus, the speech intelligibility in a linear transmission system. The SII is a function of the system's transfer function and of the acoustic input, i.e. indirectly of the speech spectrum at the output of the system. Furthermore, it is possible to take the effects of a masking noise into account in the SII.

The ANSI S3.5-1997 (Revised 2007) standard is based on hearing thresholds for normal hearing persons. However Annex A of the standard discloses a modification of the speech level distortion factor with an additional loss factor that is the part of the equivalent hearing threshold level due to the presence of a conductive hearing loss.

Various procedures have been proposed for correcting the SII protocol to include the so called supra-threshold deficits, but in the ANSI S3.5-1997 (Revised 2007) standard only the effect of an elevated hearing threshold level is included.

EP-B1-1522206 discloses a hearing aid and a method of operating a hearing aid wherein speech intelligibility is improved based on frequency band gain adjustments based on real-time determinations of speech intelligibility and loudness, and which is suitable for implementation in a processor in a hearing aid.

This type of hearing aid and operation method requires the capability of increasing or decreasing the gain independently in the different bands depending on the current sound situation. For bands with high noise levels, e.g., it may be advantageous to decrease the gain, while an increase of gain can be advantageous in bands with low noise levels, in order to maximise the SII. However, such a simple strategy will not always be an optimal solution, as the SII also takes inter-band interactions, such as mutual masking, into account. A precise calculation of the SII is therefore necessary.

This type of hearing aid and methods of enhancing speech are advantageous, but are still based on standard assumptions concerning a user's hearing loss, which means that the hearing aids and the corresponding methods, apart from the measured hearing loss threshold, cannot be individualized to the user.

It is therefore a feature of the invention to provide a method of operating a hearing aid wherein improved speech enhancement is achieved.

It is also a feature of the invention to provide a method of operating a hearing aid with improved means for individualization of the methods to the specific user.

It is a further feature of the invention to provide a hearing aid comprising means for enhancing listening comfort and means for optimizing speech intelligibility in real time.

SUMMARY OF THE INVENTION

The invention in a first aspect provides a method of processing a signal in a hearing aid, the method comprising the steps of receiving an input signal from an acoustical-electrical transducer; splitting the input signal into a multitude N of hearing aid frequency bands using a first filterbank; estimating ambient speech level and noise level in a multitude of said hearing aid frequency bands and applying a hearing aid gain to said speech level and noise level in said multitude of hearing aid frequency bands, whereby estimated speech and noise spectra are provided; estimating hearing loss levels in said multitude of said hearing aid frequency bands hereby providing an estimated hearing loss spectrum; providing excitation values for the speech and noise in said multitude of hearing aid frequency bands, by using an auditory model of the cochlea for a hearing impaired person, and the estimated speech, noise and hearing loss spectra; using said excitation values to calculate a speech intelligibility measure; and optimizing said speech intelligibility measure by iteratively varying the applied gain in the hearing aid frequency bands.

This provides a method of operating a hearing aid that provides improved speech intelligibility and listening comfort.

The invention in a second aspect provides a hearing aid system comprising frequency splitting means adapted for splitting an input signal into a multitude of frequency bands; estimating means adapted for estimating speech levels, noise levels and hearing loss levels in said frequency bands; an auditory model of the cochlea adapted for providing excitation values for speech and noise in said frequency bands; speech intelligibility estimation means adapted for calculating a speech intelligibility measure based on said excitation values; and hearing aid gain optimization means adapted for optimizing said speech intelligibility measure by varying the gain in the hearing aid frequency bands.

This provides a hearing aid with improved means for optimizing speech intelligibility.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other different embodiments, and its several details are capable of modification in various, obvious aspects all without departing from the invention. Accordingly, the drawings and descriptions will be regarded as illustrative in nature and not as restrictive. In the drawings.

DETAILED DESCRIPTION

The inventors have found that an improved method for speech enhancement in a hearing aid can be obtained by replacing estimates of sound pressure levels in the ambience with excitation pattern values that represent how the sounds are perceived by the hearing aid user.

Surprisingly the inventors have found that the complex and non-linear excitation pattern models can be implemented in a way that makes an excitation pattern model suitable for use in a hearing aid.

Further the inventors have found that the implementation of an excitation pattern model can simplify the complexity required for estimating speech intelligibility. One particularly important advantage is that the calculation of the equivalent masking spectrum level is unnecessary, since it is an implicit part of the excitation pattern model, and the same holds true for the estimation of the slope of upward spread of masking.

The inventors have further demonstrated how supra-threshold deficits, in particular the reduced frequency selectivity from hearing loss, can be included in a model for estimating speech intelligibility, and wherein said model is suitable for implementation in a hearing aid.

Additionally the inventors have shown that the use of an excitation pattern model allows the speech enhancement method to be individualized in a manner that was not possible before. In particular it has been demonstrated that consequences of inner and outer hair cell loss can be accounted for.

Finally the inventors have shown that the combined impact from inner and outer hair cell loss can be modeled in a simple manner.

Figure 1:
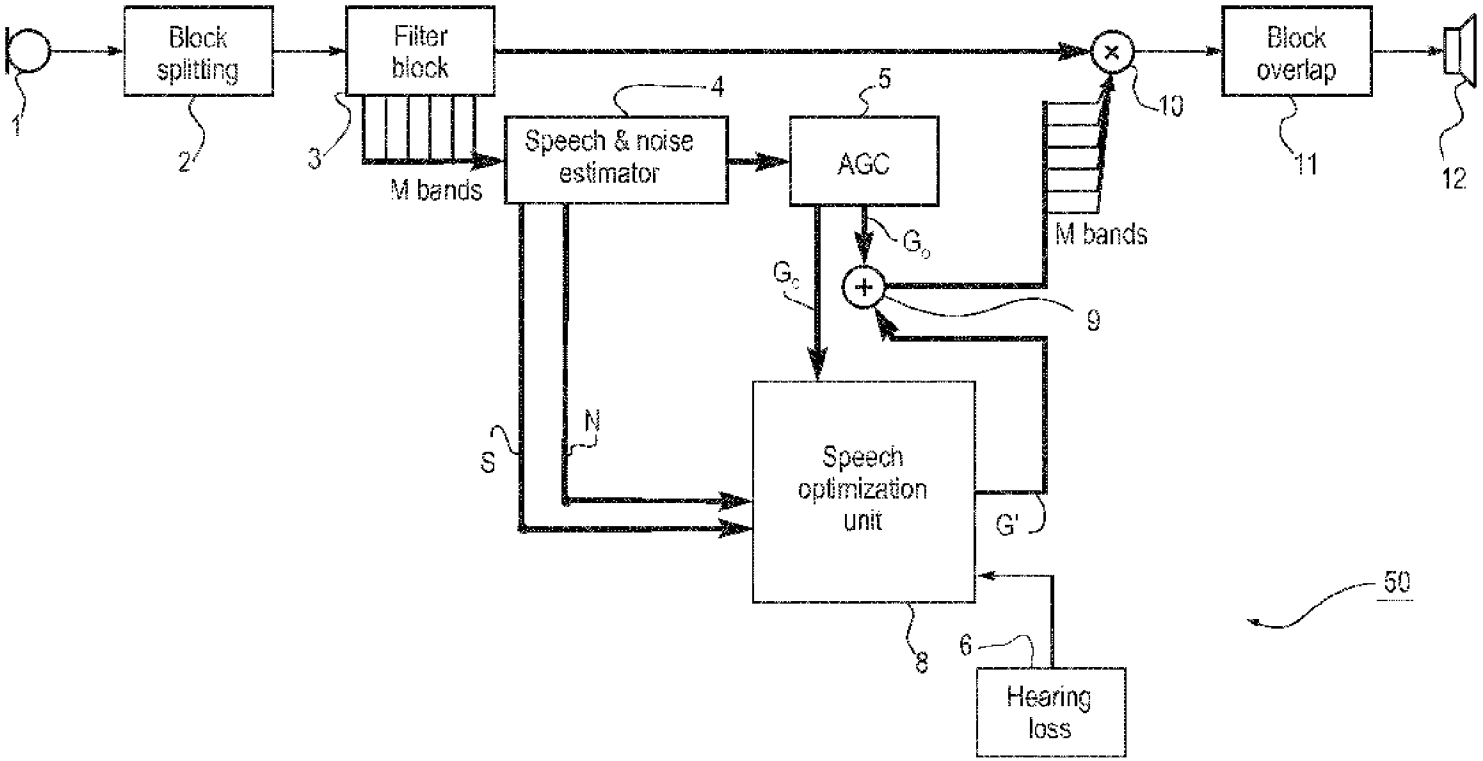
FIG. 1 illustrates highly schematically a hearing aid according to an embodiment of the invention.

Reference is first made to FIG. 1 which highly schematically illustrates a hearing aid 50 according to an embodiment of the invention.

The hearing aid 50 comprises a microphone 1 connected to a block splitting means 2, which further connects to a filter block 3. The block splitting means 2 may apply an ordinary, temporal, optionally weighted windowing function, and the filter block 3 may preferably comprise a predefined set of low pass, band pass and high pass filters defining the hearing aid frequency bands.

The total output from the filter block 3 is fed to a multiplication point 10, and the output from the separate bands 1, 2, . . . M in filter block 3 are fed to respective inputs of a speech and noise estimator 4. The outputs from the separate filter bands are shown in FIG. 1 by a single, bolder, signal line. The speech and noise estimator 4 generates two separate vectors, i.e. N for 'assumed noise', and S for 'assumed speech'. These vectors are used by the speech optimization unit 8 to distinguish between the estimated noise level and the estimated speech level.

The speech and noise estimator 4 also provides input to the AGC means 5 wherefrom the required gains $G_{0,f}$ for alleviating the hearing loss of the hearing aid user, in the various frequency bands, are determined.

The speech and noise estimator 4 may be implemented as a percentile estimator. A percentile is, by definition, the value for which the cumulative distribution is equal to or below that percentile. The output values from the percentile estimator each correspond to an estimate of a level value below which the signal level lies within a certain percentage of the time during which the signal level is estimated. The vectors preferably correspond to a 10% percentile (the noise, N) and a 90% percentile (the speech, S) respectively, but other percentile figures can be used. In practice, this means that the noise level vector N comprises the signal levels below which the frequency band signal levels lie during 10% of the time, and the speech level vector S is the signal level below which the frequency band signal levels lie during 90% of the time. The speech and noise estimator 4 implements a very efficient way of estimating for each block the frequency band levels of noise as well as the frequency band levels of speech.

A percentile estimator may be implemented e.g. as the kind presented in the U.S. Pat. No. 5,687,241.

In variations of the embodiment of FIG. 1 the noise and speech estimates may be determined by any suitable estimation means other than percentiles, and other values for the percentiles may be used. In the following the noise and speech estimates may simply be denoted noise and speech levels.

The output of multiplication point 10 is further connected to a loudspeaker 12 via a block overlap means 11. The speech and noise estimator 4 is connected to a speech optimization unit 8 and Automatic Gain Control (AGC) means 5 by two multi-band signal paths carrying respectively the estimated signal S and the estimated noise N.

The block overlap means 11 may be implemented as a band interleaving function and a regeneration function for recreating an optimized signal suitable for reproduction. The block overlap means 11 forms the final, speech-optimized signal block and presents this to the loudspeaker 12.

The AGC means provides the required gains $G_{0,f}$ for alleviating the hearing loss of the hearing aid user, in the various hearing aid frequency bands. The AGC means 5 is connected to one input of a summation point 9, feeding it with a first set of gain values $G_{0,f}$, for each hearing aid frequency band, based on the compressor characteristics and the specific hearing loss of the hearing aid user. In variations of the embodiment of FIG. 1 said first set of gain values $G_{0,f}$ simply defines the hearing aid transfer function, excluding any noise reduction and/or speech enhancement features.

Furthermore the gain values $G_{0,f}$ are fed to the speech optimization unit 8 in order to calculate the speech intelligibility value.

The AGC means 5 may be implemented as a multiband compressor, for instance of the kind described in WO-A1-2007/025569.

After optimizing the speech intelligibility, preferably by means of an iterative algorithm shown below with reference to FIG. 2, the speech optimization unit 8 presents the optimized gain values $G_f'$ to an input of the summation point 9. The summation point 9 adds the vector G' comprising the optimized gain values $G_f'$ to the input vector $G_0$ comprising the gain values $G_{0,f}$ from the AGC 5, thus forming a new, modified gain vector for the input of the multiplication point 10. Multiplication point 10 multiplies the appropriate gains from the modified gain vector to the signal from the filter block 3 and presents the resulting gain adjusted signal to the input of block overlap means 11. Hereby the hearing aid is provided with the desired transfer function.

In variations of the embodiment of FIG. 1 the speech optimization unit 8 directly provides the gain values to be applied to the signal from the filter block 3, whereby the summation point 9 can be omitted.

Figure 2:
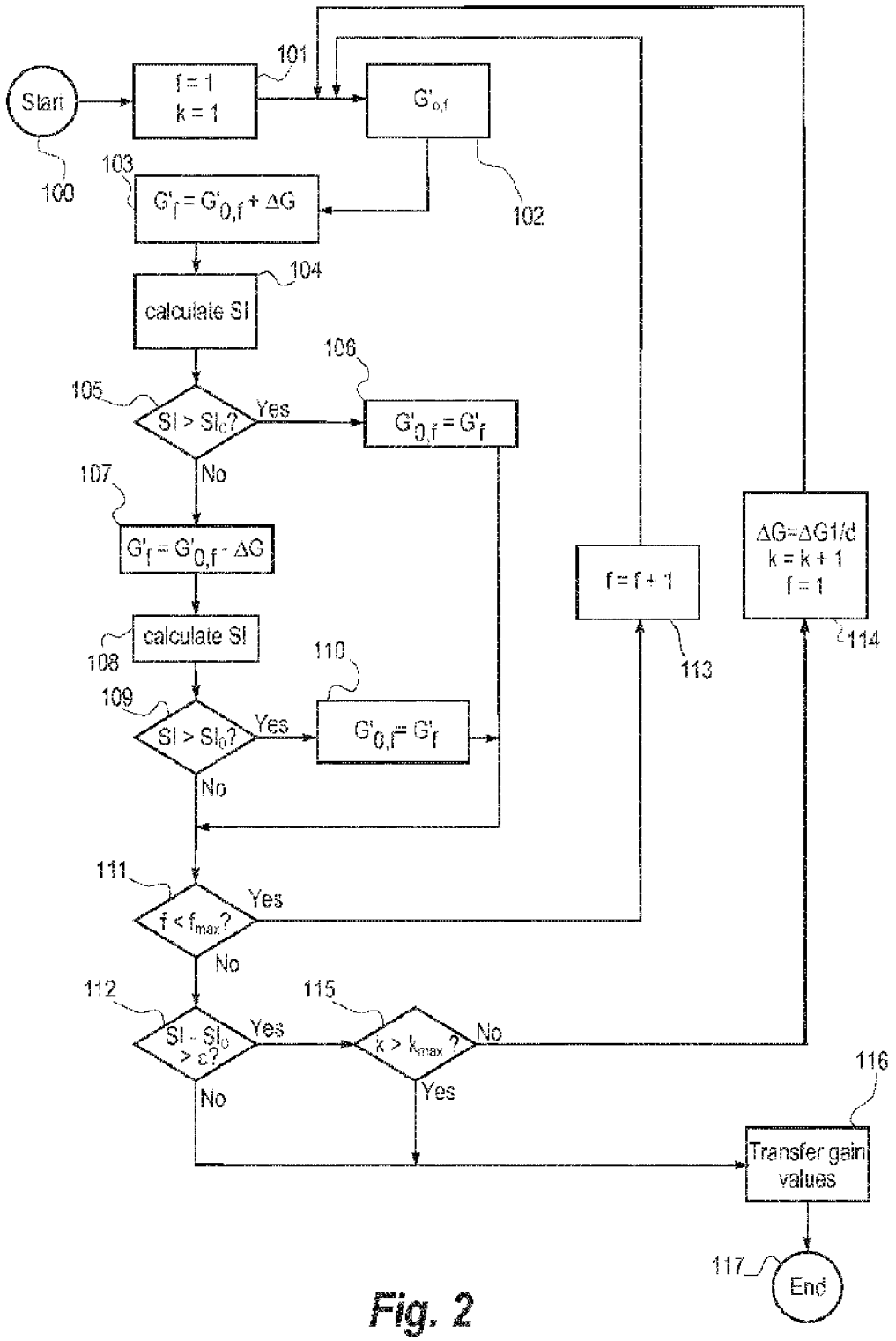
FIG. 2 is a simplified flow chart of a hearing aid gain optimization algorithm according to an embodiment of the invention.

Reference is now given to FIG. 2, which is a flow chart of a speech optimization algorithm, carried out by the speech optimization unit 8, according to an embodiment of the invention. The speech optimization algorithm comprises a start point block 100 connected to a subsequent block 101, where an initial hearing aid frequency band number f and an iteration counter k are both set to one. In the following step 102, an initial gain value $G'_{0,f}$ is set for that specific frequency band. In step 103, a new gain value $G'_f$ is defined as $G'_{0,f}$ plus a gain value increment $\Delta G_f$, followed by the calculation of a speech intelligibility value SI in step 104. After step 104, the speech intelligibility value SI is compared to an initial value $SI_0$ in step 105.

If the new SI value is larger than the initial value $SI_0$, the routine continues in step 106, where $G'_{0,f}$ is set to $G'_f$. Otherwise, the routine continues in step 107, where the new gain value $G'_f$ is set to $G'_{0,f}$ minus the incremental gain value $\Delta G_f$.

The routine then continues in step 111 by examining the hearing aid frequency band number f to see if the highest number of frequency bands $f_{max}$ has been reached.

If, however, the new SI value calculated in step 104 is smaller than the initial value $SI_0$, then the new gain value $G'_f$ is set to $G'_{0,f}$ minus the gain value increment $\Delta G_f$ in step 107. The proposed speech intelligibility value SI is then calculated again for the new gain value $G'_f$ in step 108.

The proposed speech intelligibility SI is again compared to the initial value $SI_0$ in step 109. If the new value SI is larger than the initial value $SI_0$, the routine continues in step 110, where $G'_{0,f}$ is set to $G'_f$.

If neither an increased or a decreased gain value $\Delta G$ results in an increased SI, the initial gain value $G'_{0,f}$ is preserved for the hearing aid frequency band f. The routine continues in step 111 by examining the band number f to see if the highest number of frequency bands $f_{max}$ has been reached. If this is not the case, the routine continues via step 113, incrementing the number of the frequency band f subject to optimization by one. Otherwise, the routine continues in step 112 by comparing the new SI vector with the old vector $SI_0$ to determine if the difference between them is smaller than a tolerance value c.

If any of the f values of SI calculated in each band in either step 104 or step 108 are substantially different from $SI_0$, i.e. the vectors differ by more than the tolerance value c, the routine proceeds towards step 115, where the iteration counter k is compared to a maximum iteration number $k_{max}$.

If k is smaller than $k_{max}$, the routine continues in step 114, by defining a new gain increment ΔG by multiplying the current gain increment with a factor 1/d, where d is a positive number greater than 1, and incrementing the iteration counter k. The routine then continues by iteratively calculating all $f_{max}$ frequency bands again in step 101, starting over with the first frequency band f=1. If k is larger than $k_{max}$, the new, individual gain values are transferred to the transfer function of the signal processor in step 116 and terminates the optimization routine in step 117. This is also the case if the SI did not increase by more than the tolerance value ϵ in any band (step 112). Then the need for further optimization no longer exists.

In essence, the algorithm traverses the $f_{max}$-dimensional vector space of $f_{max}$ hearing aid frequency band gain values iteratively, optimizing the gain values for each frequency band with respect to the largest SI value. Practical values for the tolerance variable c and d in this example are 0.005 and 2, respectively. The number of frequency bands $f_{max}$ may be set to 12 or 15 frequency bands. A convenient starting point for ΔG is 10 dB. Simulated tests have shown that the algorithm usually converges after four to six iterations, i.e. a point is reached where the difference between the old $SI_0$ vector and the new SI vector becomes negligible and thus execution of subsequent iterative steps may be terminated. Thus, this algorithm is very effective in terms of processing requirements and speed of convergence.

According to a variation of the invention, the optimised gain vector can be determined using an estimation of the gradient of a speech intelligibility measure as a function of the gain vector.

According to yet another variation of the invention, the optimised gain vector can be determined as disclosed in EP-B1-1522206 in FIG. 2 and the corresponding description in paragraphs 62-70.

Figure 3:
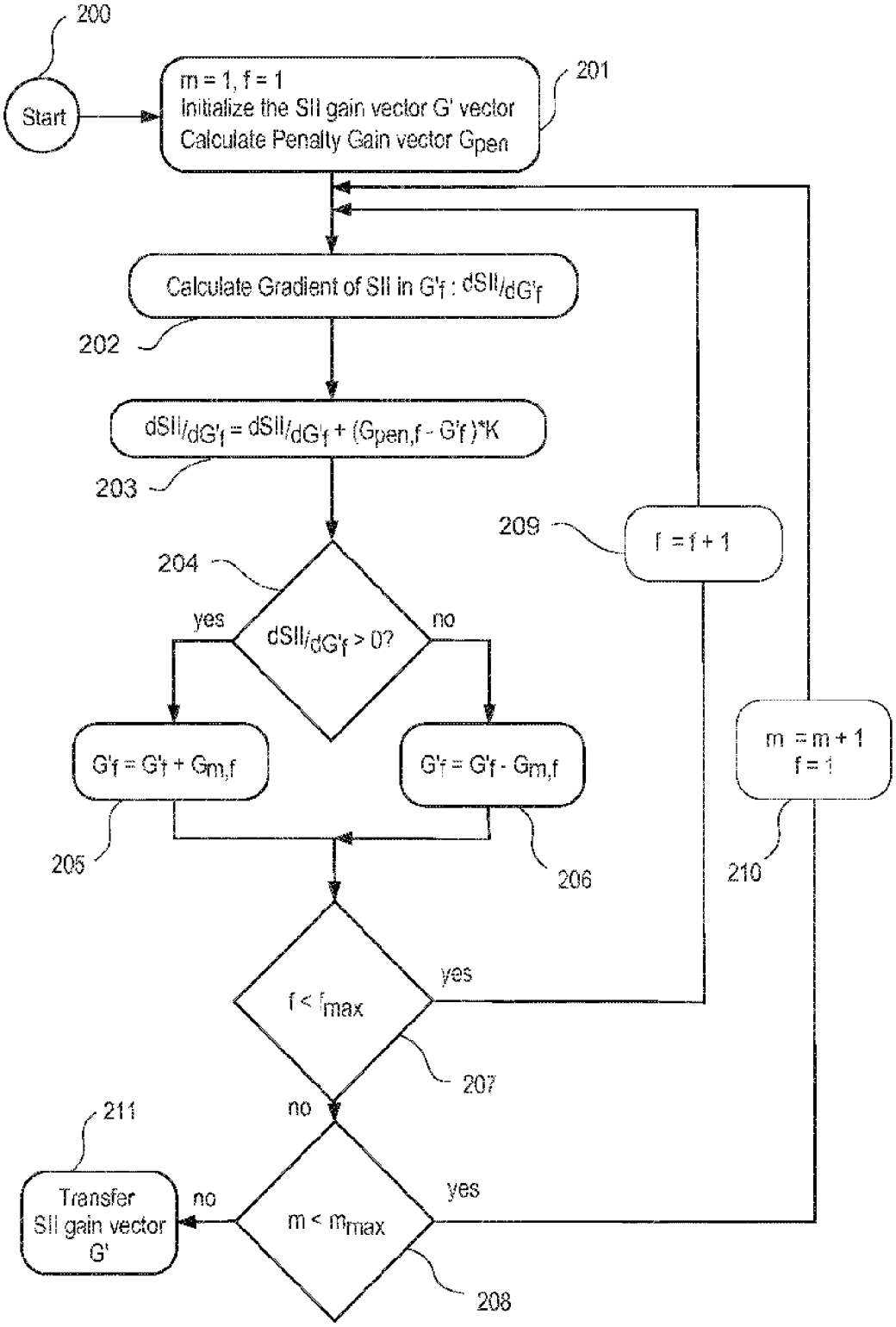
FIG. 3 is a simplified flow chart of a hearing aid gain optimization algorithm according to another embodiment of the invention.

Reference is now given to FIG. 3, which is a flow chart of a speech optimization algorithm, carried out by the speech optimization unit 8, according to another embodiment of the invention.

The flow chart comprises a start point block 200 connected to a subsequent block 201, where an initial hearing aid frequency band number f=1, an initial iteration number m=1, an SII gain vector G' and a penalty gain vector $G_{pen}$ are set. The elements of the gain vectors $G'_f$ and $G_{pen,f}$ represent the gain values corresponding to each of the hearing aid frequency bands f.

The estimated speech vector S, the estimated noise vector N and the gain values $G_{0,f}$, that are required for the calculation of the gradient of the speech intelligibility measure and the penalty gain vector $G_{pen}$, are initialized once and kept constant throughout the optimization of the SII gain vector G'.

The values of the penalty gains are selected from the range between zero and −18 dB. Further details concerning, one example of, how to provide the penalty gain vector can be found in the patent application PCT/EP2011/073746, filed 22 Dec. 2011, published as WO-A1-2013091702, particularly from page 14, line 16 and to page 16, line 2.

In the following step 202, the gradient of the speech intelligibility measure in the point $G'_f$ is determined. In the following the gradient in the point $G'_f$ may also be denoted a gradient element or a partial derivative of the gradient.

After step 202, the gradient of the speech intelligibility measure is modified in step 203 by adding a term comprising the difference between the penalty gain value $G_{pen,f}$ and the gain value $G'_f$ multiplied by a proportionality constant K.

In step 204 the sign of the modified gradient is determined. If the new modified gradient is positive the algorithm continues in step 205, where a new gain value $G'_f$ is set to the current gain value $G'_f$ plus a gain value increment $G_{m,f}$. Otherwise, the routine continues in step 206, where the new gain value $G'_f$ is set to the current gain value $G'_f$ minus the gain value increment $G_{m,f}$. The gain value increment $G_{m,f}$ may be a constant or it may vary as a function of both iteration number m and/or frequency band number f.

The algorithm then continues in step 207 by examining the frequency band number f to see if the highest number of frequency bands $f_{max}$ has been reached. If this is not the case the frequency band number f is updated by one in step 209, and the algorithm proceeds to step 202.

According to a variation of the current embodiment the gain value increment $G_m$ depends on the iteration number m such that the magnitude of the gain value increment decreases with increasing iteration number.

When the highest number of frequency bands $f_{max}$ has been reached, the algorithm continues in step 208 by examining the iteration number m to see if the highest iteration number of $m_{max}$ has been reached. If this is not the case the iteration number m is updated by one, the frequency band number f is reset to one in step 210, and the algorithm proceeds to step 202.

The inventors have found that when the highest number of iterations $m_{max}$ has been reached the need for further optimization no longer exists, and the resulting speech-optimized gain value vector G' is transferred to the transfer function of the signal processor in step 211 and the optimization routine is terminated.

In essence, the algorithm traverses the $f_{max}$-dimensional vector space of $f_{max}$ frequency band gain values iteratively, optimizing the gain values $G'_f$ for each frequency band with respect to both speech intelligibility and listening comfort.

The gradient of the speech intelligibility measure may be derived using an analytical expression which is the preferred option, but it may also be calculated based on results of empirical studies.

Figure 4:
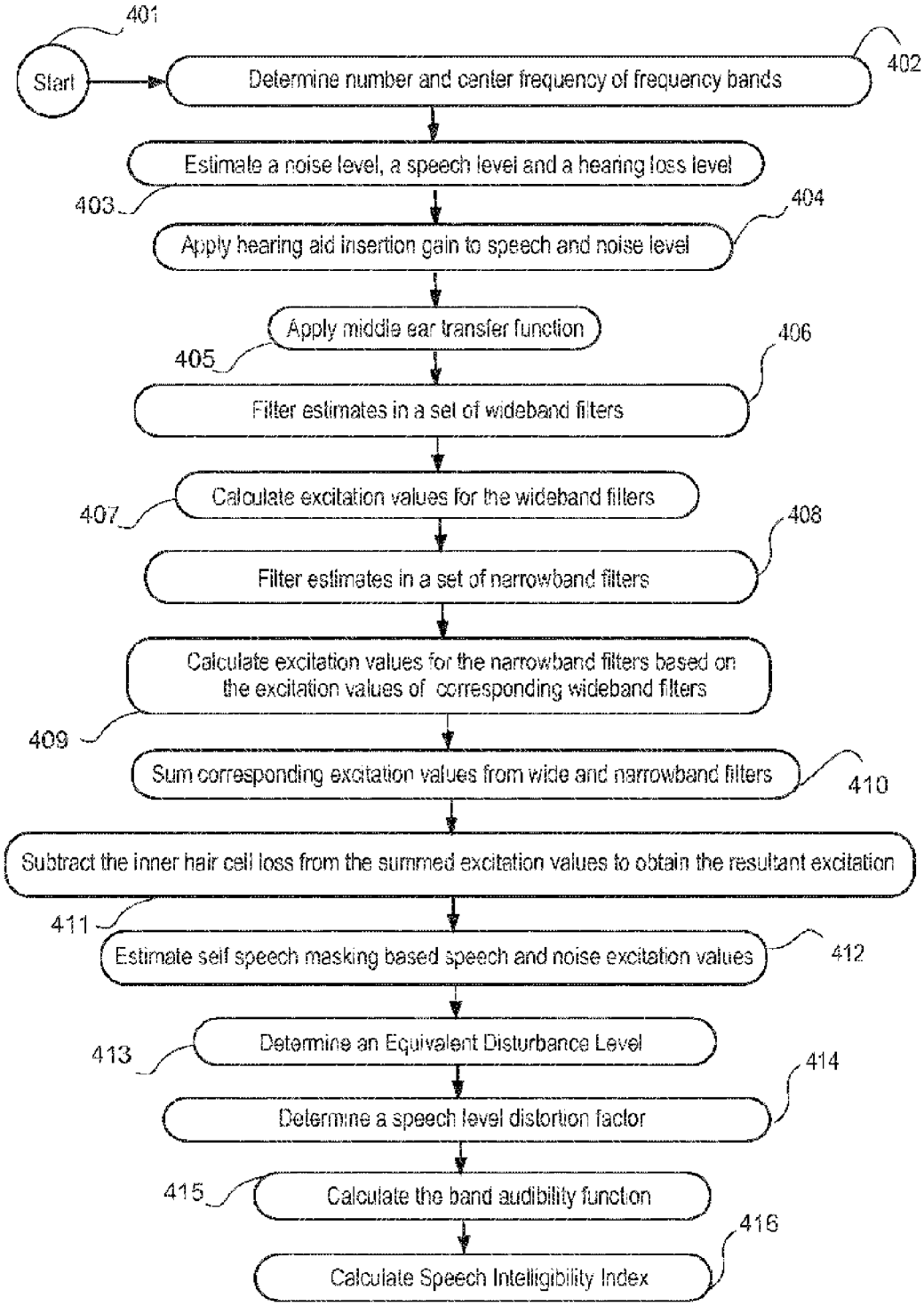
FIG. 4 is a simplified flow chart of a hearing aid algorithm adapted for estimating a speech intelligibility index.

Reference is now given to FIG. 4 that illustrates a method for deriving a speech intelligibility index according to an embodiment of the invention.

The SI algorithm initializes in step 401, and in step 402 the SI algorithm determines the number of frequency bands fmax and the center frequencies CF of the frequency bands.

According to the present embodiment only 15 frequency bands are used and the following center frequencies have been selected (all measured in Hz): 128, 220, 348, 489, 634, 796, 1002, 1264, 1594, 2006, 2530, 3213, 4155, 5688, 8720.

Thus the inventors have surprisingly found that only a limited number of frequency bands, i.e. above 10, and preferably between 12 and 18 are required to obtain a sufficiently precise model of the excitation pattern for a hearing impaired. Based on this the inventors have shown that hearing aid frequency bands that are already available in many modern hearing aids can be used to model the excitation patterns.

In step 403 an estimate of a noise signal level and a speech signal level is determined for a multitude of frequency bands, hereby providing an assumed noise vector and an assumed speech vector.

In step 404 the insertion gain to be applied by the hearing aid, in said multitude of frequency bands, is applied to the assumed noise and speech vectors, hereby providing processed noise and speech vectors.

In step 405 the acoustical effect of the middle ear on the transmission of sound from the eardrum to the cochlea (the inner ear) is taken into account using a transfer function, which is specified in ANSI S 3.4-2007. The end result of this step is a specification of the spectrum of the estimated sound levels applied to the cochlea.

According to an advantageous variation the middle ear transfer function can be determined based on air-bone gap audiometry for the individual hearing aid user, whereby a more precise and individualized estimation of the middle ear transfer function can be obtained.

In step 406 the processed noise and speech vectors are filtered in a corresponding set of wideband filters, wherein each of said wideband filters $W_w$ are defined by the equations:

$$W_w(CF, f \le CF) = \left(1 + \frac{CF - f}{CF} t_l(CF)\right) e^{\frac{CF-f}{CF} t_l(CF)}$$

and $$W_w(CF, f > CF) = \left(1 + \frac{f - CF}{CF} t_u(CF)\right) e^{\frac{f-CF}{CF} t_u(CF)}$$

wherein f is the sound frequency, CF is the center frequency of the wideband filter and $t_l(CF)$ and $t_u(CF)$ are parameters describing the shape of the filter for frequencies below and above the center frequency CF, respectively.

In step 407 the excitation $E_w(CF)$ at the output of a wideband filter with center frequency CF given an input with power spectrum X(f) is given by:

$$E_w(CF) = \int X(f) \cdot W_w(f, CF) df$$

According to the present embodiment the power spectrum X(f) is obtained based on the estimated noise or speech levels in the hearing aid frequency bands.

In step 408 the processed noise and speech vectors are filtered in a corresponding set of narrowband filters, wherein each of said narrowband filters $W_n$ are defined by the equations:

$$W_n(CF, f \le CF) = G(CF) \cdot \left(1 + \frac{CF - f}{CF} p_l(CF)\right) e^{\frac{CF-f}{CF} p_l(CF)}$$

and $$W_n(CF, f > CF) = G(CF) \cdot \left(1 + \frac{f - CF}{CF} p_u(CF)\right) e^{\frac{f-CF}{CF} p_u(CF)}$$

wherein $p_l$ (CF) and $P_u(CF)$ are parameters describing the shape of the filters for frequencies below and above the center frequency CF, respectively and wherein G(CF) represents a linear gain that is controlled by the output from a wideband filter as specified in the following.

In step 409 the excitation $E_n$ at the output of a narrowband filter given an input with power spectrum X(f) is given by:

$$E_n(CF) = \int X(f) \cdot W_n(CF) df$$

The excitation $E_w(CF)$ at the output of a wideband filter $W_w(CF)$ is used to control the corresponding linear gain G(CF) of a narrowband filter, given in the equations of step 408, according to the formulas:

$$G_{dB}(CF) = G_{dB,Max}(CF) \left\{1 - \frac{1}{1 + e^{-0.05(E_{dB,w} - (100 - G_{dB,Max}(CF)))}} + \frac{1}{1 + e^{0.05(100 - G_{dB,Max}(CF))}}\right\}, \quad \text{when } E_{dB,w} \le 30$$

and $$G_{dB}(CF) = G_{dB,Max}(CF) \left\{1 - \frac{1}{1 + e^{-0.05(E_{dB,w} - (100 - G_{dB,Max}(CF)))}} + \frac{1}{1 + e^{0.05(100 - G_{dB,Max}(CF))}}\right\} - 0.003(E_{dB,w} - 30)^2, \text{ when } E_{dB,w} > 30$$

wherein $G_{dB,Max}(CF)$ is the maximum gain, in dB, of the narrowband filter having the center frequency CF. $G_{dB,Max}$ (CF) is determined based on the Outer Hair Cell loss (OHCL):

$$G_{dB,Max}(CF) = G_{db,Max,normal}(CF) - OHCL_{dB}(CF)$$

wherein $G_{dB,Max,normal}(CF)$ represents the maximum gain of the narrowband filter for a normal hearing. This corresponds to the gain of the narrowband filter for very low input levels. When the input level is increased, the gain of the narrowband filter $G_{dB}(CF)$ is reduced as given by the formulas above. This in turn leads to reduced frequency selectivity and reduced compressive nonlinearity. When $OHCL_{dB}$ (CF)=0 dB there is no outer hair cell loss.

In step 410 the excitation at the output of the narrowband and wideband filters are summed, hereby providing the summed excitations $E_{dB}(CF)$.

In step 411 the summed excitations $E_{dB}(CF)$ are modified by including the effects of Inner Hair Cell Loss (IHCL) according to the formula, hereby providing the resultant excitation $E_{dB}$ (CF) given by:

$$E_{dB}(CF) = E_{dB}(CF) - IHCL_{dB}(CF)$$

The resultant excitation will in the following be denoted $EP_{noise}$ if derived from a noise spectrum, and $EP_{speech}$ if derived from a speech spectrum.

By incorporating a model of the hair cell loss proportion (i.e. outer hair cell loss relative to inner hair cell loss) as a function of the hearing loss threshold, the inventors have demonstrated that speech intelligibility estimation, relying on inner and outer cell losses, can be provided based only on a measurement of the hearing loss threshold.

According to the present embodiment, the proportion of inner and outer hair cell is estimated based on the following table:

| | | | | | | | | | | |
|---|---|---|---|---|---|---|---|---|---|---|
| IHL [dB] | 10 | 12 | 13 | 14 | 15 | 16 | 26 | 37 | 45 | 56 |
| OHL [dB] | 0 | 8 | 17 | 26 | 35 | 44 | 44 | 43 | 44 | 44 |
| HTL [dB] | 10 | 20 | 30 | 40 | 50 | 60 | 70 | 80 | 90 | 100 |

However, in variations the inner hair cell loss and outer hair cell loss may also be determined using well known measurement techniques.

In step 412 a self-speech-masking (SSM) spectrum is estimated based on calculated resultant excitation spectrums derived from processed noise and speech spectra according to the formula:

$$SSM(CF)=k_1\cdot(EP_{speech}(CF-1)+EP_{speech}(CF+1))+EP_{noise}(CF)$$

where $k_1$ is a constant that is set to 1 and according to variations is in the range between zero and one.

In step 413 a measure D(CF) corresponding to an Equivalent Disturbance Level as defined in the ANSI S 3.5-1997 is derived as the largest of the hearing loss spectrum and the self-speech-masking spectrum SSM(CF).

In step 414 a speech level distortion factor L(CF) is calculated as:

$$L(CF)=1-(EP_{speech}(CF)-U(CF)-k_4)/k_5$$

The standard speech spectrum level at normal vocal effort, U(CF) can be obtained from Table 1 of ANSI S 3.5-1997. The inventors have discovered that $k_4$ can be set to 7 while $k_5$ can be set to 40. However, the inventors have discovered that an appropriate value of $k_4$ can also be selected from the range between 1 and 30 and that a value for $k_5$ can be selected from the range between 1 and 60.

The band audibility A is calculated in step 415 as:

$$A(CF)=L(CF)\cdot K(CF)\cdot I(CF)$$

The temporary variable K(CF), which may be denoted audible speech, is calculated according to the formula:

$$K(CF)=(EP_{speech}(CF)-D(CF)+k_2)/k_3$$

wherein k2 is set to 15 and k3 is set to 30 and wherein, according to variations, k2 is in the range between 1 and 30 and k3 is in the range between 1-60, and wherein I(CF) is the band importance function that is used to weigh the audibility with respect to speech frequencies.

The total speech intelligibility index SII is calculated in step 416 as the sum of the band audibilities in each of the hearing aid frequency bands.

We claim:

1. A method of processing a signal in a hearing aid, the method comprising the steps of:

receiving an input signal from an acoustical-electrical transducer;

splitting the input signal into a multitude N of hearing aid frequency bands using a first filterbank;

estimating ambient speech level and noise level in a multitude of said hearing aid frequency bands and applying a hearing aid gain to said speech level and noise level in said multitude of hearing aid frequency bands, whereby estimated speech and noise spectra are provided;

estimating hearing loss levels in said multitude of said hearing aid frequency bands hereby providing an estimated hearing loss spectrum;

providing excitation values for the speech and noise in said multitude of hearing aid frequency bands, by using an auditory model of the cochlea for a hearing impaired person, and the estimated speech, noise and hearing loss spectra;

using said excitation values to calculate a speech intelligibility measure; and optimizing said speech intelligibility measure by iteratively varying the applied gain in the hearing aid frequency bands, wherein the step of providing the excitation values comprises the steps of:

applying a frequency dependent gain to the estimated speech and noise spectra, wherein said frequency dependent gain is adapted to account for the acoustical effect of the middle ear;

providing a second filter bank having N band-pass filters with center frequencies corresponding to those of said first filter bank;

filtering the estimated speech and noise spectra in a filter of said second filter bank, hereby providing first filtered speech and noise spectra;

integrating as a function of frequency said first filtered spectra to obtain a first intermediate excitation value at the output of said filter from the second filter bank;

providing a third filter bank having N band-pass filters with center frequencies corresponding to said first filter bank;

determining the transfer function of a filter from said third filter bank using the first intermediate excitation value at the output of said filter from the second filter bank and using an estimate of the hearing loss due to outer hair cell loss;

filtering the estimated speech and noise spectra in said filter of said third filter bank, hereby providing second filtered speech and noise spectra;

integrating as a function of frequency said second filtered spectra to obtain a second intermediate excitation value at the output of said filter from the third filter bank; and adding the first and second intermediate excitation values, hereby providing an excitation value, for that specific hearing aid frequency band, to be used for calculating a speech intelligibility measure.

2. The method of processing according to claim 1, wherein the step of providing the excitation values comprises a step of:

modifying said excitation value by subtracting the value of the inner hair cell loss.

3. The method of processing according to claim 1, wherein said multitude of hearing aid frequency bands is in the range between 12 and 18.

4. A method of processing a signal in a hearing aid, the method comprising the steps of:

receiving an input signal from an acoustical-electrical transducer;

splitting the input signal into a multitude N of hearing aid frequency bands using a first filterbank;

estimating ambient speech level and noise level in a multitude of said hearing aid frequency bands and applying a hearing aid gain to said speech level and noise level in said multitude of hearing aid frequency bands, whereby estimated speech and noise spectra are provided;

estimating hearing loss levels in said multitude of said hearing aid frequency bands hereby providing an estimated hearing loss spectrum;

providing excitation values for the speech and noise in said multitude of hearing aid frequency bands, by using an auditory model of the cochlea for a hearing impaired person, and the estimated speech, noise and hearing loss spectra;

using said excitation values to calculate a speech intelligibility measure; and optimizing said speech intelligibility measure by iteratively varying the applied gain in the hearing aid frequency bands, wherein said step of using said excitation values to calculate a speech intelligibility measure comprises:

estimating a self speech masking level based on an excitation value derived from an estimated speech level and on an excitation value derived from an estimated noise level;

estimating a disturbance level as the maximum value of a self-speech masking level and an estimated hearing threshold;

estimating audible speech based on the difference between an excitation value derived from an estimated speech level and a disturbance level;

determining a level distortion factor using an excitation value derived from an estimated speech level;

multiplying, for a given hearing aid frequency band, a value of the level distortion factor, a value of the audible speech and a value of a band importance function, hereby providing an intermediate speech intelligibility measure in said hearing aid frequency band; and summing, for at least two hearing aid frequency bands, said intermediate speech intelligibility measures to provide a speech intelligibility measure.

5. A method of processing a signal in a hearing aid, the method comprising the steps of:

receiving an input signal from an acoustical-electrical transducer;

splitting the input signal into a multitude N of hearing aid frequency bands using a first filterbank;

estimating ambient speech level and noise level in a multitude of said hearing aid frequency bands and applying a hearing aid gain to said speech level and noise level in said multitude of hearing aid frequency bands, whereby estimated speech and noise spectra are provided;

estimating hearing loss levels in said multitude of said hearing aid frequency bands hereby providing an estimated hearing loss spectrum;

providing excitation values for the speech and noise in said multitude of hearing aid frequency bands, by using an auditory model of the cochlea for a hearing impaired person, and the estimated speech, noise and hearing loss spectra;

using said excitation values to calculate a speech intelligibility measure; and optimizing said speech intelligibility measure by iteratively varying the applied gain in the hearing aid frequency bands, said method further comprising the step of:

estimating the hearing loss for a specific user due to respectively inner hair cell loss and outer hair cell loss based on an estimation of the proportion of hearing loss due to respectively inner hair cell loss and outer hair cell loss as a function of overall hearing loss, such that for hearing deficits below 20 dB and for hearing deficits exceeding 90 dB the proportion of hearing loss attributed to inner hair cell loss is larger than 50% while for hearing deficits in the range between 30 dB and 80 dB the proportion of hearing loss attributed to inner hair cell loss is less than 50%.

6. A hearing aid system comprising:

a first filter bank configured to split an input signal into a multitude of frequency bands;

a level estimator configured to estimate speech levels, noise levels and hearing loss levels in said frequency bands;

an auditory model of the cochlea for a hearing impaired person, configured to provide excitation values for speech and noise in said frequency bands;

a speech intelligibility estimator configured to calculate a speech intelligibility measure based on said excitation values; and a hearing aid gain optimizer configured to optimize said speech intelligibility measure by varying the gain in the hearing aid frequency bands;

wherein said speech intelligibility estimator comprises:

a masking level estimator configured to estimate a self speech masking level based on an excitation value derived from an estimated speech level and on an excitation value derived from an estimated noise level;

a disturbance level estimator configured to estimate a disturbance level as the maximum value of a self-speech masking level and an estimated hearing threshold;

an audible speech estimator configured to estimate audible speech based on the difference between an excitation value derived from an estimated speech level and a disturbance level;

a distortion level determination component configured to determine a level distortion factor using an excitation value derived from an estimated speech level;

a multiplier for multiplying, for a given hearing aid frequency band, a value of the level distortion factor, a value of the audible speech and a value of a band importance function, hereby providing an intermediate speech intelligibility measure in said hearing aid frequency band; and a combiner for summing, for at least two hearing aid frequency bands, said intermediate speech intelligibility measures to provide a speech intelligibility measure.

7. The hearing aid system according to claim 6, wherein said multitude of hearing aid frequency bands is in the range between 12 and 18.

* * * * *